US009217432B2

(12) United States Patent
Maeder et al.

(10) Patent No.: US 9,217,432 B2
(45) Date of Patent: Dec. 22, 2015

(54) PENDULUM-SLIDE PUMP HAVING VARIABLE GROOVE RADII GREATER IN TRANSITION THAN THEREBETWEEN

(71) Applicant: Mahle International GmbH, Stuttgart (DE)

(72) Inventors: Andre Maeder, Hildburghausen (DE); Eike Stitterich, Aschersleben (DE)

(73) Assignee: Mahle International GmbH (DE)

( * ) Notice: Subject to any disclaimer, the term of this patent is extended or adjusted under 35 U.S.C. 154(b) by 144 days.

(21) Appl. No.: 13/847,870

(22) Filed: Mar. 20, 2013

(65) Prior Publication Data

US 2013/0251580 A1 Sep. 26, 2013

(30) Foreign Application Priority Data

Mar. 21, 2012 (DE) ..... 10 2012 204 500

(51) Int. Cl.

| | |
|---|---|
| ***F04C 2/348*** | (2006.01) |
| ***F04C 14/22*** | (2006.01) |
| ***F01C 21/08*** | (2006.01) |
| ***F04C 2/332*** | (2006.01) |
| *F04C 2/324* | (2006.01) |

(52) U.S. Cl.

CPC ..... *F04C 14/22* (2013.01); *F01C 21/0809* (2013.01); *F04C 2/332* (2013.01); *F04C 2/348* (2013.01); *F04C 2/324* (2013.01); *F04C 2250/20* (2013.01)

(58) Field of Classification Search

CPC ..... F04C 2/324; F04C 2/332; F04C 2/336; F04C 2/322; F04C 2/46; F04C 18/322; F04C 18/332; F04C 18/46; F04C 2/348; F04C 18/348; F01C 1/0809

USPC ..... 418/173, 164, 259, 260, 266–268; 74/63; 417/247, 310, 410.3

See application file for complete search history.

(56) References Cited

U.S. PATENT DOCUMENTS 4,125,031 A 11/1978 Swain

FOREIGN PATENT DOCUMENTS

| | | | | |
|---|---|---|---|---|
| CH | 257830 | A | 10/1948 | |
| DE | 19532703 | C1 | 11/1996 | |
| DE | 10334672 | B3 * | 1/2005 | ..... F01C 1/332 |
| DE | 102009006453 | A1 | 7/2010 | |
| DE | 102010007255 | A1 * | 8/2011 | |
| FR | 980766 | A | 5/1951 | |

OTHER PUBLICATIONS

"Stress Concentrations". Wikipedia. Dec. 3, 2011. Accessible at https://web.archive.org/web/20111203074810/http://en.wikipedia.org/wiki/Stress_concentration.*

(Continued)

*Primary Examiner* — Thomas Denion
*Assistant Examiner* — Laert Dounis
(74) *Attorney, Agent, or Firm* — Fishman Stewart Yamaguchi PLLC

(57) ABSTRACT

A pendulum-slide pump may include a rotatingly mounted inner rotor connected via at least one pendulum with an outer rotor. The inner rotor may define a plurality of radial grooves configured to receive the pendulum. The grooves may have two groove walls that continues via a rounded region into a shared groove base. The rounded region may have variable groove radii and continue with at least a reduced curvature jump into the groove base or the groove walls. The groove radii may be greated in the translation to the groove walls and to the groove base than therbetween.

8 Claims, 3 Drawing Sheets

(56) References Cited
OTHER PUBLICATIONS

English language abstract of DE 195 32 703, Nov. 21, 1996.

English language abstract of DE 10 2009 006 453, Jul. 29, 2010.

* cited by examiner

PENDULUM-SLIDE PUMP HAVING VARIABLE GROOVE RADII GREATER IN TRANSITION THAN THEREBETWEEN

CROSS-REFERENCE TO RELATED APPLICATION

This application claims priority to German Patent Application 10 2012 204 500.7, filed Mar. 21, 2012, which is hereby incorporated by reference in its entirety.

TECHNICAL FIELD

The present invention relates to a pendulum-slide pump with a rotatingly mounted inner rotor, which is connected via pendulums with an outer rotor, according to the introductory clause of claim 1. The invention also relates to a use of such a pendulum-slide pump in a motor vehicle, and an inner rotor for such a pendulum-slide pump.

BACKGROUND

The use of quantity-controlled pendulum-slide pumps in internal combustion engines has been prior art for a long time, in order for example to be able to easily adapt a delivery rate and a pressure of a fluid which is to be conveyed to the requirements of the internal combustion engine.

From DE 195 32 703 C1 for example such a generic pendulum-slide pump is known for supplying an internal combustion engine with lubricant, in particular with oil.

A disadvantage in the known pendulum-slide pumps, however, is in particular the high stress of the inner rotor at particularly sensitive sites, namely at a transition from a groove wall to a groove base or respectively in the groove base itself. In the described embodiment, the pendulums are mounted here articulatedly on the outer rotor and are guided radially in the previously described grooves in the inner rotor.

SUMMARY

The present invention is therefore concerned with the problem of indicating an improved embodiment for a pendulum-slide pump of the generic type, which is distinguished in particular by an improved construction and thereby an increased lifespan and an increased loading capacity.

This problem is solved according to the invention by the subject matter of the independent claims. Advantageous embodiments are the subject matter of the dependent claims.

The present invention is based on the general idea of modifying a groove geometry, i.e. a geometry of the radial guidance of a pendulum in an inner rotor or in an outer rotor such that, compared with groove geometries hitherto, the stress, in particular in a transition from a groove base into the lateral groove walls/groove flanks, i.e. in the rounding region, can be distinctly reduced. The pendulum-slide pump according to the invention has, for this, a rotatingly mounted inner rotor, which is connected via said pendulums with an outer rotor. The pendulums are articulatedly mounted on the outer rotor and are guided radially in an associated groove in the inner rotor or vice versa, wherein then the grooves would be arranged in the outer rotor. According to the invention, the grooves have respectively two groove walls or respectively groove flanks, which continue respectively via a rounding region into a shared groove base. The rounding region has variable groove radii and therefore continues without or with at least a reduced curvature jump into the groove base and the groove walls. Variable groove radii means that these groove radii are greater in the transition to the groove walls and to the groove base than therebetween. This means that the groove wall continues over a large groove radius and hence a small curvature into the rounding region. Subsequently, the groove radius is reduced towards the centre of the rounding region, so that the curvature increases there. The groove radius increases again towards the groove base, whereby the curvature decreases and the rounding region continues into the groove base without or with at least a greatly reduced curvature jump. Preferably, no curvature jump is provided here in the transition between groove base, rounding region and groove wall. Nevertheless, a change in curvature direction, even though reduced, can still be present in the groove base itself, which change in curvature direction, however, does not extend into the rounding region. By avoiding a curvature jump which was present hitherto in the transition between the groove base or respectively the groove wall and the respective rounding region, the stress of the inner rotor or respectively of the outer rotor can be distinctly reduced at particularly endangered sites, i.e. in particular in the transition from the groove base/groove wall to the rounding region, and thereby the lifespan of the inner rotor/outer rotor and also of the pendulum-slide pump can be distinctly increased. The production of the altered groove geometry is able to be realized simply here with regard to manufacturing technology, for example by means of an altered sintering tool, wherein changes at the feet of the individual pendulums are not necessary, so that the latter can be adopted unchanged. A depth of the respective groove can also be remain unchanged compared with groove depths hitherto, so that the advantage according to the invention of the distinctly increased wear resistance can be achieved by a simple exchange of the inner rotor/outer rotor. Particularly advantageous in addition to the increased wear resistance are in particular the increase in endurance strength and hence in lifespan and the increase in efficiency of the interconnection between a drive shaft and the respective inner rotor and hence the torque which is able to be transmitted.

In an advantageous further development of the invention, the transition from groove base via the rounding region into the associated groove wall is constructed without a change in the curvature direction. In this case, therefore, a consistent curvature direction exists both in the region of the groove base and also in the region of the transition to the rounding region or respectively to the groove wall, whereby the stress can again be reduced and hence the lifespan and the wear resistance can be extended.

In a further advantageous embodiment of the solution according to the invention, the groove base has an elliptical shape, wherein a first radius of the ellipsoidal groove base corresponds to approximately half the groove width and a second radius corresponds to approximately ⅜ of the first radius. Hereby also considerable increases to the dynamic security or respectively the lifespan can be achieved.

With the altered groove geometry according to the invention it is therefore possible to significantly reduce the stresses for an inner rotor of a pendulum-slide pump, in particular in its highly stressed regions, and thereby to distinctly increase the life expectancy and the wear resistance of the inner rotor. In a transferred sense, what has been described above correspondingly also applies of course to outer rotors, in which the pendulums are articulated internally.

Further important features and advantages of the invention will emerge from the subclaims, from the drawings and from the associated description of the figures with the aid of the drawings.

It shall be understood that the features mentioned above and to be further explained below are able to be used not only in the respectively indicated combination, but also in other combinations or in isolation, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWINGS

There are shown here, respectively diagrammatically.

DETAILED DESCRIPTION

Figure 1:
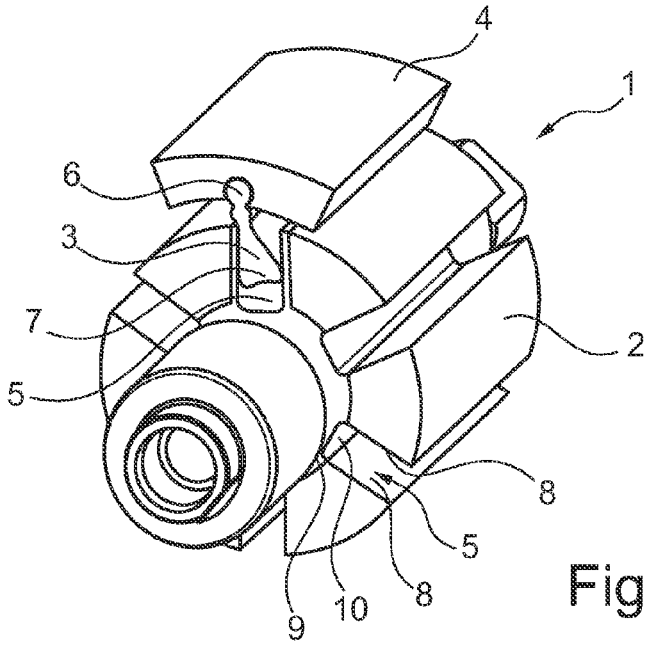
FIG. 1 a cutout of a pendulum-slide pump according to the invention.

According to FIG. 1, a pendulum-slide pump 1 according to the invention has a rotatingly mounted inner rotor 2, which is connected via pendulums 3 with an outer rotor 4. For the sake of clarity, only cutouts of the outer rotor 4 and only a single pendulum 3 are drawn here. The pendulum 3 which is drawn is mounted articulatedly on the outer rotor 4 and is guided in radial direction in an associated groove 5 in the inner rotor 2. In general, the pendulum 3 consists of a pendulum head 6 and a pendulum foot 7, wherein the pendulum head 6 is rotatably mounted on the outer rotor 4 and the pendulum foot 7 is mounted so as to be movable in a translatory manner in the groove 5 on the inner rotor 2. Of course, a reverse embodiment is also conceivable, in which the pendulum head 6 of the pendulum 3 is rotatably mounted on the inner rotor 2 and the pendulum foot 7 can be moved in a translatory manner in a groove arranged on the outer rotor 4. The inner rotor 2 is produced as a part, in particular in a single piece, for example in a sintering process. The dual tonality presented in FIG. 1 has no significance. The inner rotor 2 could, however, also be constructed from several materials in layers.

The pendulum-slide pump 1 can be used for example for supplying an internal combustion engine, not shown, with lubricant, for example oil, wherein alternatively it is also conceivable that it is used for other fluids which are to be conveyed, such as for example cooling agent, coolant or water. The groove 5 has two groove walls/groove flanks 8, which continue via rounding regions 9 into a shared groove base 10. In a transition region of groove wall 8, rounding region 9 and groove base 10 a locally existing curvature is illustrated as a strip plot. This runs from point A via B and C to point D. In FIG. 2-5, various rotor groove geometries and the respective curvature are illustrated here. The curvature here is the derivation of the rolling curve which occurs when the groove radii s and the groove base 10 are considered as a curve. The derivation is the mathematical derivation of the rolling curve. This derivation corresponds to the curvature of the rolling curve. If the curvature is constant, as is the case in a circle with a fixed radius, then in the diagram a constantly long line s with envelope g is to be seen, see FIG. 2*b*). In points B and C according to FIG. 2, the curvature jumps from a negative value to a positive (or vice versa). Here, a curvature direction change 11 and a curvature jump 12 are present. The length of the line s indicates the size of the curvature. At FIG. 2*b* in point B, C the curvature jumps, because simply at the site the rounding region, in the form of a segment of a circle, continues into the groove base 10, in the form of a segment of a circle, wherein in points B and C the curvature direction reverses. Therefore, the envelope g has at these two points B and C a discontinuity in the form of a curvature jump 12. This means that the rolling curve is not constant with regard to curvature over the entire course from A via B and C to D. It is, however, in the partial regions A to B, B to C and C to D, but not in points B and C. At these sites, point B and C, on continuous operation the mechanical stress of the inner rotor 2 is greatest, so that here fractures of the inner rotor 2, due to stress, can most likely occur. This constitutes the known state of the inner rotor 2.

The local curvature (rolling curve) can be measured by mechanical or optical measurement methods on each inner rotor 2 and it can also be determined in most design programmes. Possible loading limits for various rolling curves can be determined by complex calculations. The findings which are thereby obtained lead to inner rotors 2 with new inventive geometry, which are expected to show a higher lifespan of the pendulum-slide pumps 1.

Figure 2:
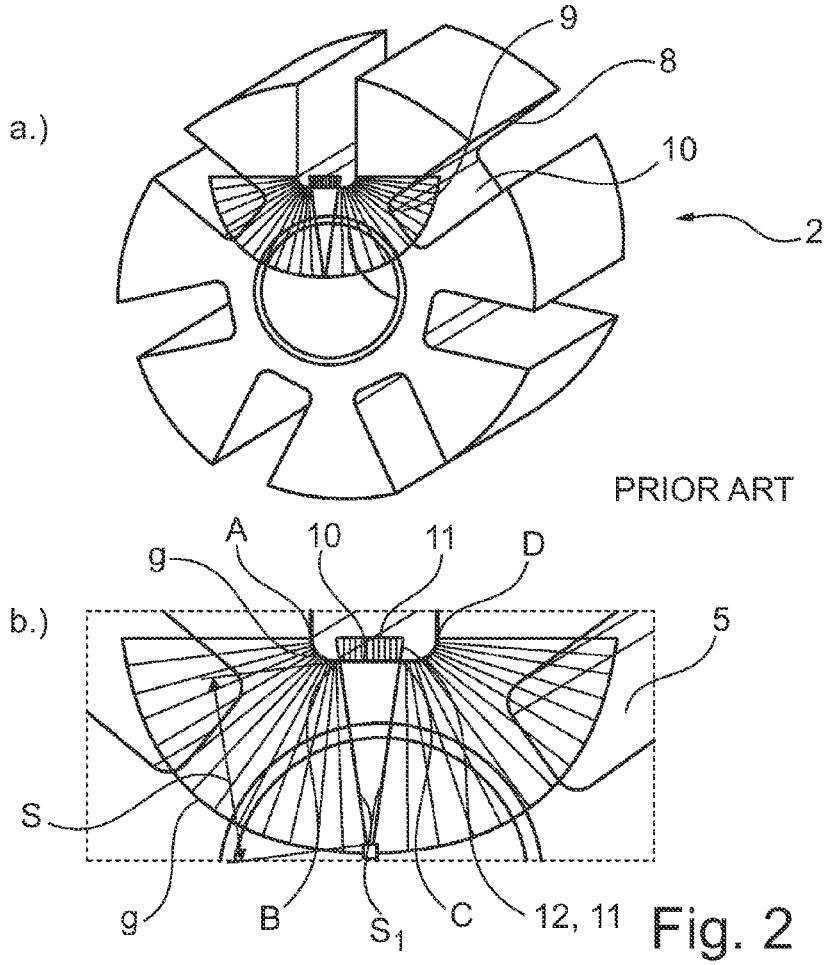
FIG. 2*a* a groove geometry in an inner rotor of the pendulum-slide pump according to the prior art, with locally existing curvatures as a strip plot, FIG. 2*b* a detail of FIG. 2*a*, FIG. 3*a* an illustration as in FIG. 2, but with a groove geometry according to the invention with greatly reduced curvature jumps at the transition from groove wall/groove base to the rounding region, FIG. 3*b* a detail of FIG. 3*a*, FIG. 4 an inner rotor according to the invention, in which the groove base without curvature direction change with a very small curvature jump continues from the groove base into the rounding region and with reduced curvature jump from the groove wall into the rounding region, FIG. 5 an alternative embodiment to FIG. 4 without curvature direction change/curvature jump in the region of the groove base and of the rounding region, but with greater curvature jump from the groove wall to the rounding region.

If one now considers the groove geometry of the grooves 5, as they are constructed according to the prior art according to FIG. 2, one can see that in the region of the groove base 10 at points B and C a curvature direction change 11 and a curvature jump 12 is present, which has a negative effect on the resistance to wear and the lifespan of the inner rotor 2 according to the invention or respectively of the associated pendulum-slide pump 1. The same also applies to points A and D, i.e. in the transition between the groove walls 8 and the adjoining rounding region 9. The groove 5 according to FIG. 2 has tangentially constant radii s here in the rounding regions 9, wherein the groove base 10 itself is curved in a slightly convex manner to the interior of the groove.

Figure 3:
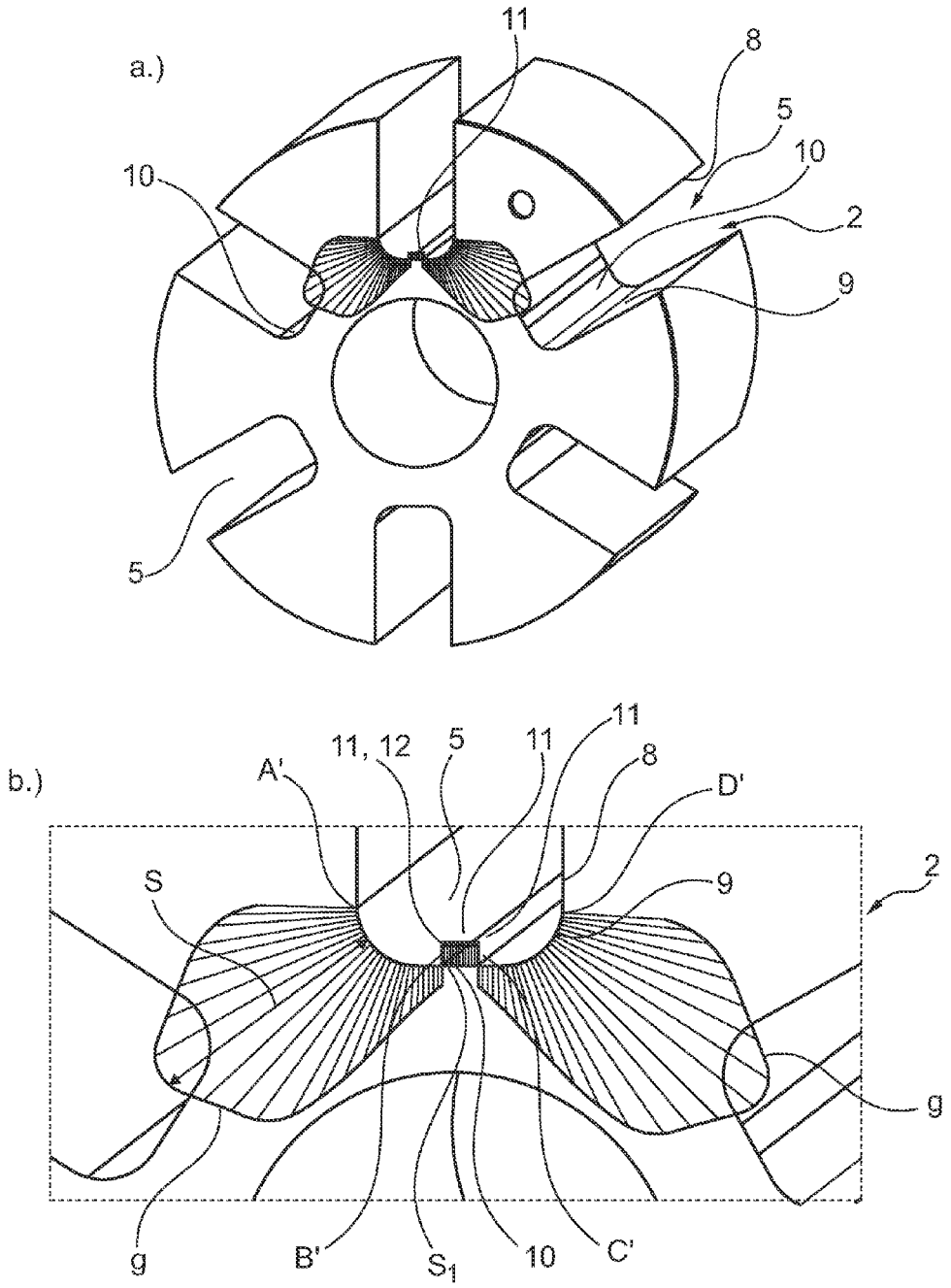

In order to be able to increase the lifespan of the pendulum-slide pump 1, in the inner rotor 2 according to the invention according to FIG. 3 the grooves 5 are constructed in the rounding region 9 with variable radii s and hence also with variable curvatures and with a flat, non-curved groove base 10. Here also the curvature direction change 11, having a negative effect per se, is present, however the curvature jump 12, as the envelope g shows, is distinctly smaller. In points B' and C' the length of the line $s_1$ is distinctly less than in FIG. 2*b*. The size s and hence the radius and the curvature vary here along the rolling curve, g is the envelope thereto. It is noticeable here that the region with reversed curvature is distinctly narrower and distinctly smaller than in FIG. 2.

Through the fact that the rounding region 9 has variable groove radii s and these groove radii s are greater in the transition to the groove walls 8 and to the groove base 10 than therebetween in the rounding region 9, the latter continues without or with at least reduced curvature jump 12 into the groove base 10 and the groove walls 8.

Figure 4:
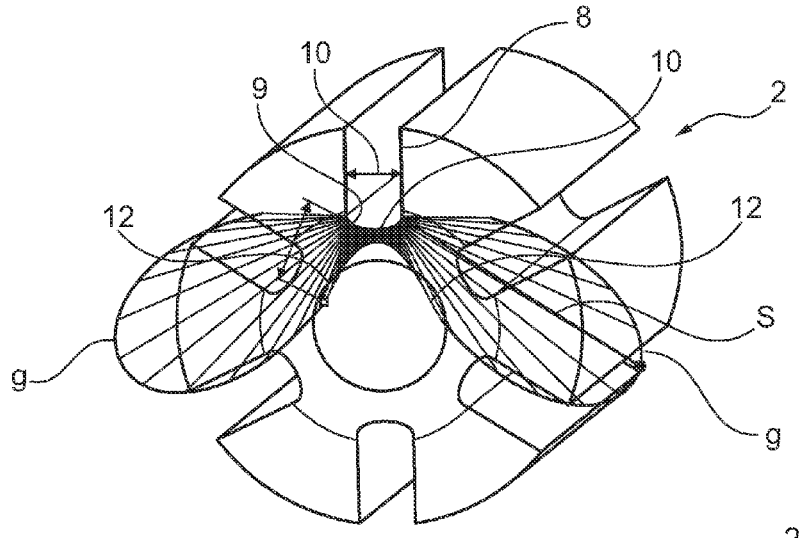
Figure 4:
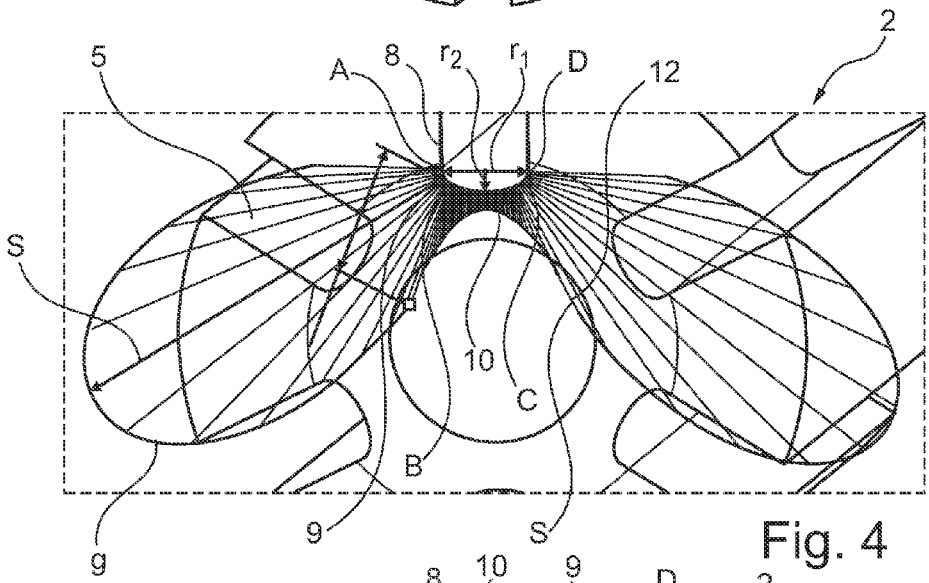

If one considers the inner rotor 2 according to the invention in accordance with FIG. 4, then the transition between the groove base 10 and the rounding regions 9 is constructed here without a curvature direction change 11, but with a slight curvature jump 12. In the transition points B, C between groove base 10 and rounding region 9 no curvature direction change 11 is present, whereby an increase of a dynamic security and hence also of the lifespan can be achieved compared with an inner rotor 2 illustrated according to FIG. 1. The entire rolling curve from A via B, C to D has no curvature direction change 11 here, only a small curvature jump 12 in points B and C. In the transition between the rounding region 9 and the groove walls 8, the curvature jump 12 is, however, greater than in the example embodiment according to FIG. 3. A first radius $r_1$ of the ellipsoidal groove base 10 corresponds here to approximately half of a groove width b (cf. FIG. 4, top), whereas a second radius $r_2$ corresponds in approximately half of the first radius $r_1$. In a modified embodiment of the elliptical groove base 10 according to the invention, the first radius $r_1$ corresponds approximately to half of the groove width b and the second radius $r_2$ to approximately ⅜ of the first radius $r_1$. Hereby, the elliptical form is given a distinctly flatter shape.

Figure 5:
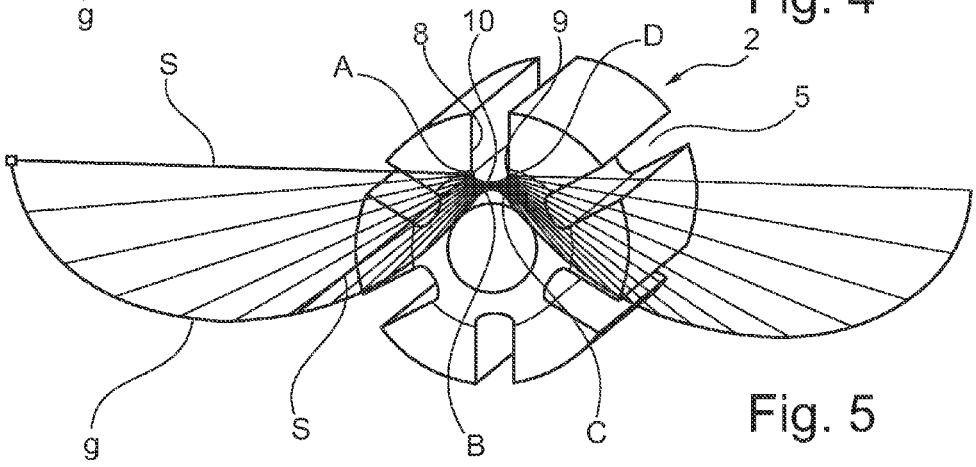

If one considers the inner rotor 2 according to the invention in accordance with FIG. 5, then here the transition between the groove base 10 and the rounding regions 9 is constructed without curvature direction change 11 and without curvature jump 12. In the transition points B, C between groove base 10 and rounding region 9 no curvature direction change 11 and also no curvature jump 12 is present, whereby likewise an increase of a dynamic security and hence also of the lifespan can be achieved compared with an inner rotor 2 illustrated according to FIG. 1. The entire rolling curve from A via B, C to D again here has no curvature direction change 11. In the transition between the rounding region 9 and the groove walls 8, the curvature jump 12 is, however, distinctly greater than in the example embodiment according to FIGS. 3 and 4. In all example embodiments, the rounding regions 9 and the groove base 10 are constructed here with constant curvature, as for example in the embodiment in FIGS. 2 and 3. However, it is essential to the invention that the rounding region 9 has variable groove radii s and is constructed such that it continues without or with at least reduced curvature jump 12 into the groove base 10 and/or the groove walls 8 and that the groove radii s in the transition to the groove walls 8 and to the groove base 10 are greater than therebetween.

In the inner rotor 2 illustrated according to FIG. 5, the groove base 10 also has an elliptical shape, i.e. also a contour with constant curvature, whereby in turn no curvature direction change 11 is present in the groove base 10. In addition also no curvature jump 12 is present in points B and C at the transition of the rounding regions 9 to the groove base 10.

If one considers the embodiments according to FIGS. 3 to 5, a distinct increase can be observed of the static and dynamic security of the embodiments with regard to the embodiment according to FIG. 2, wherein FIG. 2 represents the basis. The greatest increase can be achieved with the embodiment according to FIGS. 4 and 5.

In the illustrated figures, the region of the transition of the groove walls 8 to the rounding regions 9, i.e. in points A and D was not optimized with respect to the curvature consistency, this is, however, also possible there and, if applicable, expedient. In practice, not such high stresses have occurred in points A and D, so that the risk of a fracture of the inner rotor 2 practically does not exist there. For these transitions is it entirely sufficient if the groove walls 8 continue so smoothly into the rounding regions 9 that the pendulums 3 of the pendulum-slide pump 1 can slide thereover in an almost frictionless manner.

Altogether, it can therefore be stated that by means of the modified groove geometry according to the invention a distinctly increased dynamic security and hence a distinctly increased lifespan of the pendulum-slide pump 1 according to the invention can be achieved, without other components of the pendulum-slide pump 1 according to the invention, for example pendulums 3, having to be altered for this in any way.

The invention claimed is:

1. A pendulum-slide pump, comprising:

a rotatingly mounted inner rotor-connected via at least one pendulum with an outer rotor, wherein the inner rotor defines a plurality of radial grooves configured to receive the at least one pendulum, wherein the grooves have respectively two groove walls, which continue via respectively a rounding region into a shared groove base, wherein the rounding region has variable groove radii and continues with a discontinuity of curvature into at least one of the groove base and the groove walls, wherein the groove base further includes a curvature direction change; and wherein the groove radii are greater in the transition to the groove walls and to the groove base than the variable groove radii therebetween.

2. The pendulum-slide pump according to claim 1, wherein the transition from the groove base to the groove wall is constructed without a curvature direction change.

3. The pendulum-slide pump according to claim 1, wherein the groove base has an elliptical shape and a groove width measured between the two groove walls.

4. The pendulum-slide pump according to claim 3, wherein a first radius of the ellipsoidal groove base corresponds to half of the groove width, and a second radius corresponds to half of the first radius.

5. The pendulum-slide pump according to claim 3, wherein a first radius of the ellipsoidal groove base corresponds to half of the groove width, and a second radius corresponds to 0.375 of the first radius.

6. A use of a pendulum-slide pump according to claim 1 configured for use in a motor vehicle with an internal combustion engine or with a hybrid drive or with an electric drive.

7. The pendulum-slide pump according to claim 1, wherein the variable groove radii includes a plurality of radii of curvature.

8. The pendulum-slide pump according to claim 1, wherein the rounding region has a variable curvature.

* * * * *